US008814730B2

(12) United States Patent
Pfeifer

(10) Patent No.: US 8,814,730 B2
(45) **Date of Patent: *Aug. 26, 2014**

(54) COVER FOR THE SHAFT OF ATHLETIC EQUIPMENT

(76) Inventor: Vincent Pfeifer, Massapequa, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/544,081

(22) Filed: Jul. 9, 2012

(65) Prior Publication Data

US 2012/0316013 A1 Dec. 13, 2012

Related U.S. Application Data

(63) Continuation of application No. 12/892,144, filed on Sep. 28, 2010, now Pat. No. 8,241,154, which is a continuation of application No. 11/975,288, filed on Oct. 18, 2007, now Pat. No. 7,828,680.

(60) Provisional application No. 60/852,777, filed on Oct. 19, 2006.

(51) Int. Cl.
*A63B 59/02* (2006.01)
*A63B 65/12* (2006.01)

(52) U.S. Cl.
CPC *A63B 59/02* (2013.01); *A63B 65/12* (2013.01)
USPC ..... 473/513; D21/724

(58) Field of Classification Search
USPC ..... 473/480–484, 300, 316, 319, 505, 512, 473/513, 549, 560, 568; 74/551.9; D21/724, 727; D24/105; D8/321
See application file for complete search history.

(56) References Cited

U.S. PATENT DOCUMENTS

| | | | | | |
|---|---|---|---|---|---|
| 399,340 | A | * | 3/1889 | Morgan | 473/549 |
| 1,165,484 | A | * | 12/1915 | Zimmerman | 473/568 |
| 1,749,207 | A | * | 3/1930 | Blair | 138/118 |
| 2,038,840 | A | * | 4/1936 | Hall | 29/235 |
| 2,261,959 | A | * | 11/1941 | Buttikofer | 473/285 |
| 2,577,345 | A | * | 12/1951 | McEwen | 128/844 |
| 3,606,325 | A | * | 9/1971 | Sparks et al. | 473/298 |
| 3,606,326 | A | * | 9/1971 | Sparks et al. | 473/300 |
| 3,729,196 | A | * | 4/1973 | Heald, Jr. | 473/520 |
| 3,992,570 | A | * | 11/1976 | Beinhaur | 174/135 |
| 4,016,640 | A | * | 4/1977 | Briggs | 29/450 |
| 4,185,375 | A | * | 1/1980 | Brown | 29/450 |
| 4,912,836 | A | * | 4/1990 | Avetoom | 29/450 |
| 5,419,031 | A | * | 5/1995 | McLendon | 29/450 |
| 5,626,527 | A | * | 5/1997 | Eberlein | 473/203 |
| 5,904,615 | A | * | 5/1999 | Jeong et al. | 451/443 |
| 5,934,154 | A | * | 8/1999 | Noel | 74/551.9 |

(Continued)

*Primary Examiner* — Gene Kim
*Assistant Examiner* — M Chambers
(74) *Attorney, Agent, or Firm* — Galgano & Associates, PLLC; Thomas M. Galgano; Jessica G. Bower

(57) ABSTRACT

A sheath for an article of athletic equipment having a shaft, which includes a cap and a rolled sheath. The cap is mounted on the free end of the athletic equipment and the sheath is unrolled onto the shaft to the desired length or the entire length of the shaft. The cap and sheath are preferably made from injection molded rubber, neoprene of other polymers that permit production in various thickness, colors and lengths. The elasticity of the material preferably gives it memory and durability. The diameter of the sheath is preferably smaller than the diameter of the shaft of the athletic equipment so that it stretches to a tight fit. After the sheath is unrolled to the desired length, excess material may be cut off, if desired.

9 Claims, 4 Drawing Sheets

(56) References Cited

U.S. PATENT DOCUMENTS 6,709,346 B1 * 3/2004 Wang ..... 473/300
6,904,615 B2 * 6/2005 Kobe et al. ..... 2/161.8
7,828,680 B2 * 11/2010 Pfeifer ..... 473/513
8,241,154 B2 * 8/2012 Pfeifer ..... 473/560
2012/0316013 A1 * 12/2012 Pfeifer ..... 473/513

* cited by examiner

COVER FOR THE SHAFT OF ATHLETIC EQUIPMENT

CROSS-REFERENCE TO RELATED APPLICATIONS

This application is a continuation of application Ser. No. 12/892,144, filed Sep. 28, 2010 now U.S. Pat. No. 8,241,154, which is a continuation of application Ser. No. 11/975,288, filed on Oct. 18, 2007, now U.S. Pat. No. 7,828,680, issued on Nov. 9, 2010, which claims benefits from U.S. Provisional Patent Application No. 60/852,777, filed Oct. 19, 2006, the contents of which are hereby incorporated herein by reference.

BACKGROUND OF THE INVENTION

1. Field of the Invention

This invention relates broadly to sporting or athletic equipment. More particularly, this invention relates to athletic equipment having a shaft. Most particularly, the invention especially relates to a sheath-like cover for a lacrosse stick.

2. State of the Art

Lacrosse is a team sport that is played with either ten players (men's field), six players (men's box), or twelve players (women's field), each of whom uses a netted stick (the crosse) in order to pass and catch a hard rubber ball with the aim of scoring goals (each worth one point traditionally, but Major League Lacrosse uses a two point goal for goals scored from a distance of 16 yards or greater from the goal) by propelling the ball into the opponent's goal. The team scoring the most points after two halves, of varying length from competition to competition, and overtime if necessary, wins.

Most popular in North America, lacrosse is Canada's national summer sport. It has grown in popularity in the United States, becoming the fastest growing sport at the high school and NCAA levels.

Lacrosse sticks generally include a relatively long shaft with a netted head attached to one end of the shaft. The shaft is typically octagonal in cross section and is fitted with an end cap at the end not connected to the netted head.

Traditionally, lacrosse sticks have been made of wood, although today most are made from metals such as aluminum or alloys and/or composites. The players or manufacturers typically wrap the shaft with tape. The tape enhances the grip of the stick and, in the case of wood sticks, also tends to protect the player from splinters. However, the tape is generally unsightly and attracts dirt. When removed, it leaves behind a sticky residue. Many players find themselves replacing the tape frequently.

SUMMARY OF THE INVENTION

Accordingly, it is an object of the present invention to provide a sports equipment handle, especially the shaft of a lacrosse stick, with a sheath-like cover which improves one's grip and avoids the problems of the prior art.

It is a further object of the present invention to provide such a cover which is lightweight, easy and facile to use, and is relatively inexpensive.

It is another object of the present invention to provide such a cover that can absorb impact and shock and minimize splinters in wood shafts.

It is yet a further object of the invention to provide such a cover which facilitates imprinting with team names, colors, slogans, inspirational sayings or advertising.

Certain of the foregoing and related objects are attained according to the invention by the provision of a cover for a lacrosse stick, comprising a base cap and a rolled flexible tubular sheath coupled to said base cap, wherein said rolled sheath is configured so that it can be unrolled onto the shaft of a lacrosse stick with the base cap abutting and mounted on the end of the shaft.

Preferably, the sheath is cylindrical, has a pebbled texture on its outer surface and/or is made from a flexible elastic polymer. Desirably, the base cap is cup-shaped.

In a preferred embodiment, a cover for a lacrosse stick comprises a rolled flexible tubular sheath configured so that it can be unrolled onto the shaft of a lacrosse stick, said sheath having a pebbled texture on its outer surface. The sheath is also preferably cylindrical and/or made from a flexible elastic polymer.

Certain of the foregoing and related objects are also attained according to the invention by the provision of a kit comprising a lacrosse stick having a shaft and a netted head and a rolled flexible tubular sheath configured so that it can be unrolled onto the shaft of said lacrosse stick. The kit advantageously further comprises a cup-shaped cap coupled to said sheath. Most desirably, said cap is integrally formed with said sheath and said sheath is cylindrical.

In yet a further embodiment of the invention, a cover for athletic equipment having a shaft comprises a base cap and a rolled flexible tubular sheath coupled to said base cap, wherein said rolled sheath is configured so that it can be unrolled onto the shaft with the base cap abutting and mounted on the end of the shaft. Here, too, the sheath is preferably cylindrical and has a pebbled texture on its outer surface and/or is made from a flexible elastic polymer. The base cap is desirably cup-shaped.

As noted above, the present invention provides a preferably unitary cap and rolled sheath cover. The cap is mounted on the free end or butt of a lacrosse stick and the sheath is unwrapped or unrolled onto the stick to the desired length or the entire length of the stick. The cap and sheath are preferably made from injection molded rubber, neoprene or other polymers that permit production in various thickness, colors and lengths. The elasticity of the material preferably gives it memory and durability. The diameter of the sheath is preferably smaller than the diameter of the lacrosse stick so that it stretches to a tight fit. After the sheath is unrolled to the desired length, excess material may be cut off, if desired.

As further noted above, the sheath is provided with a pebbled texture. The pebbled texture enhances grip and channels away moisture. This also enhances player performance in wet weather conditions. The material is also temperature neutral so that it can enhance performance in cold weather conditions. The invention eliminates the need for tape and makes old lacrosse sticks look new again. The sheath can be quickly and easily removed from a lacrosse stick for use on another stick or for storage until used again. Unlike tape, the invention does not leave behind any damaging residual adhesive.

According to alternate embodiments of the invention, the sheath is color coordinated to team colors. The sheaths may also be imprinted with, e.g., team names, slogans, inspirational sayings or advertising.

Additional objects and advantages of the invention will become apparent to those skilled in the art upon reference to the detailed description taken in conjunction with the provided figures.

DETAILED DESCRIPTION

Figure 1:
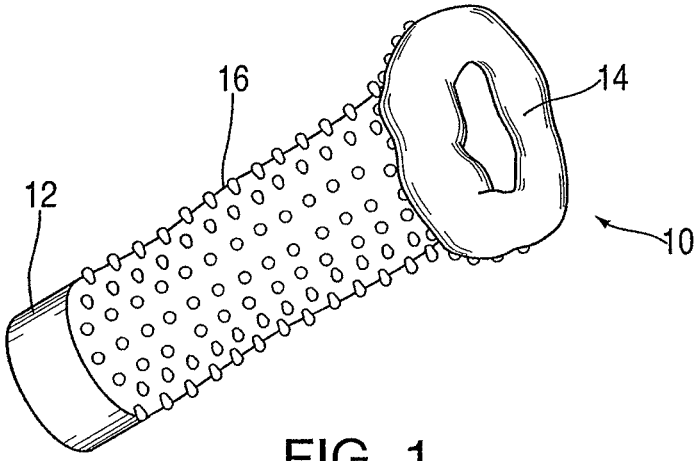
FIG. 1 is a perspective view of a first embodiment of the invention partially unrolled.
Figure 2:
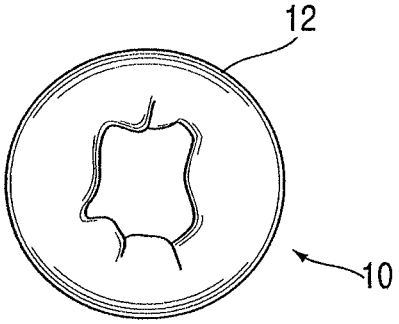
FIG. 2 is a top plan view of the open end of the sheath.
Figure 3:
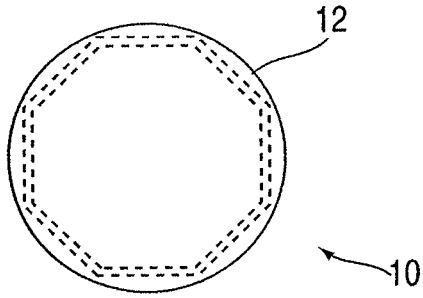
FIG. 3 is a bottom plan view of the end cap with the octagonal end of the lacrosse stick in phantom line.
Figure 4:
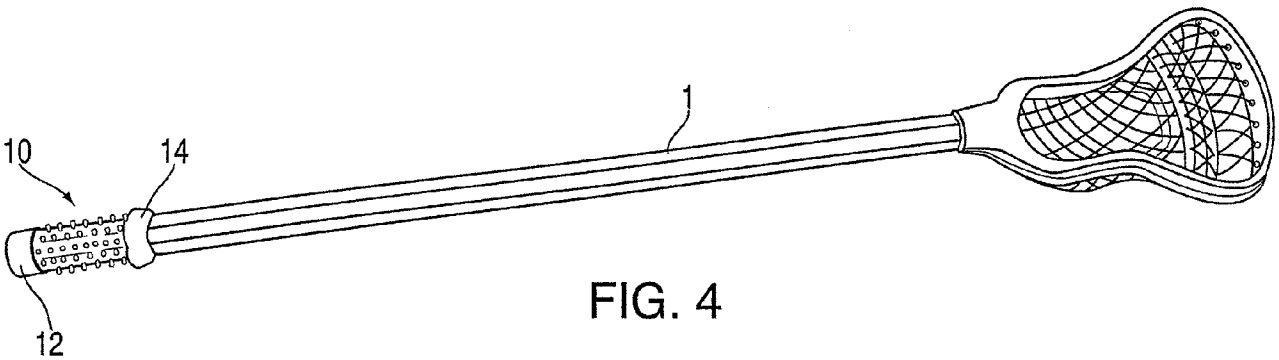
FIG. 4 is a perspective view of a lacrosse stick with the first embodiment of the invention partially installed.
Figure 5:
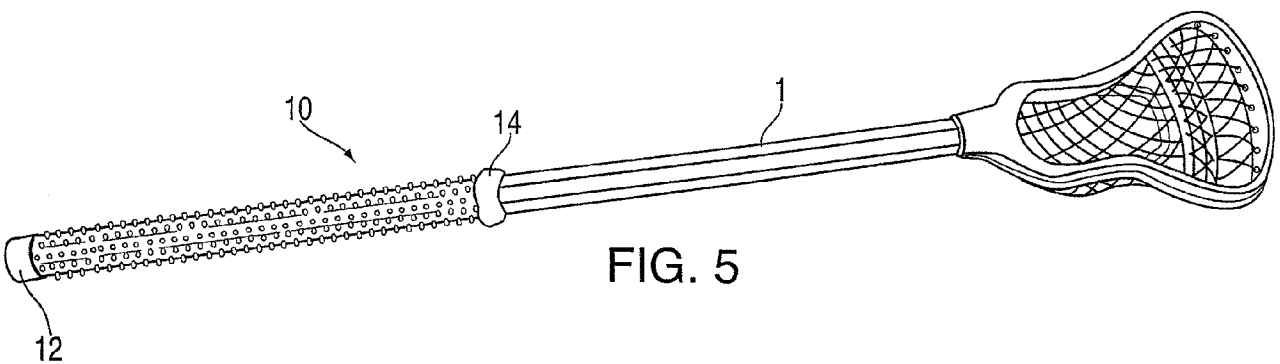
FIG. 5 is a perspective view of a lacrosse stick with the first embodiment of the invention more fully installed.
Figure 6:
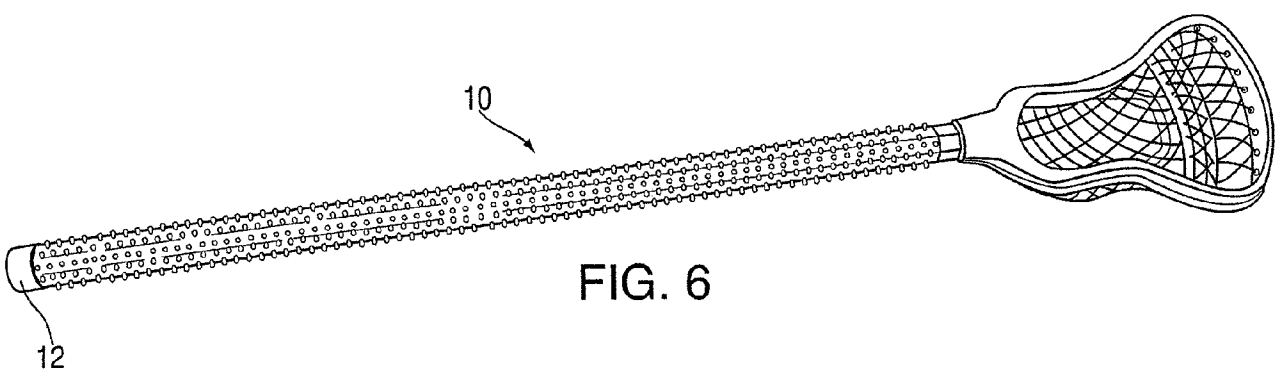
FIG. 6 is a perspective view of a lacrosse stick with the first embodiment of the invention completely installed.

Turning now to FIGS. 1-3, a cover 10 according to the present invention includes a generally cup-shaped, end cap 12 and a tubular, preferably cylindrical sheath 14 coupled to the open end of the end cap which sheath is normally in a wrapped, furled or rolled state. As shown in FIG. 4, the cap 12 is mounted on the free end or butt of a lacrosse stick 1 in a friction-fit manner and the relatively-thin, resilient, membrane-like sheath 14 is unrolled onto the shaft of stick to a desired length as shown in FIG. 5 or the entire length of the shaft as shown in FIG. 6 to thereby, in effect, provide the shaft with a resilient "skin". The cap 12 and sheath 14 are preferably integrally formed in one piece and made from injection molded rubber, synthetic rubber, neoprene or other synthetic plastic polymers that permit production in various thickness, colors and lengths. The elasticity of the material preferably gives it memory and durability. The sheath 14 and cap 12 are preferably cylindrical and are dimensioned to enable a friction fit on the shaft of the lacrosse stick which, as shown in phantom view in FIG. 3, is typically octagonal. The thickness of the cap 12 may be several times thicker than the thickness of the sheath 14. The diameter of the sheath 14 is preferably smaller than the diameter of the lacrosse stick 1 so that it stretches to a tight fit. After the sheath 14 is unrolled to the desired length, excess material may be cut off, if desired.

According to the presently preferred embodiment, the sheath 14 is provided with a pebbled texture 16 on its outer surface. The pebbled texture enhances grip and channels away moisture. This also enhances player performance in wet weather conditions. The material is preferably also temperature neutral so that it can enhance performance in cold weather conditions. The invention eliminates the need for tape and makes old lacrosse sticks look new again. Unlike tape, the invention does not leave behind any damaging residual adhesive. It also improves the safety of the stick as it provides a full sheath to protect the player from splintering wood shafts caused by checking during the game. The sheath can be quickly and easily removed from a lacrosse stick for use on another stick or it can be stored, e.g., in a pouch (not shown) until used again.

Figure 7:
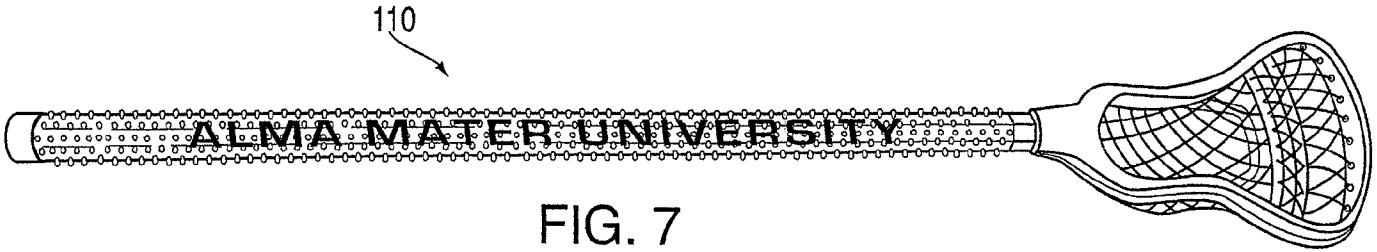
FIG. 7 is a perspective view of a lacrosse stick with a second embodiment of the invention completely installed.
Figure 8:
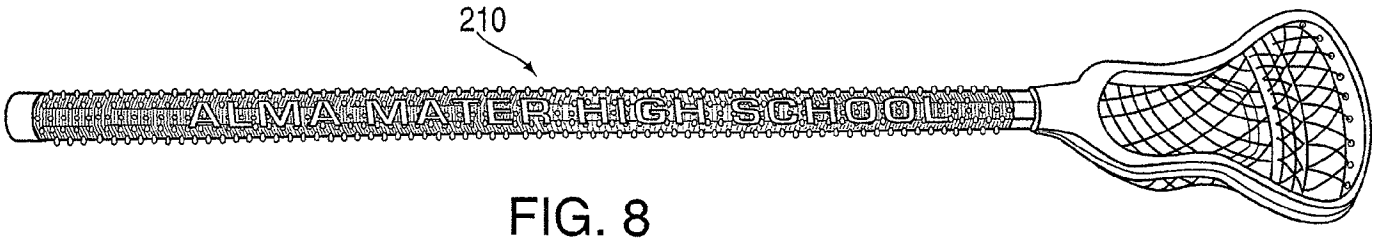
FIG. 8 is a perspective view of a lacrosse stick with a third embodiment of the invention completely installed.
Figure 9:
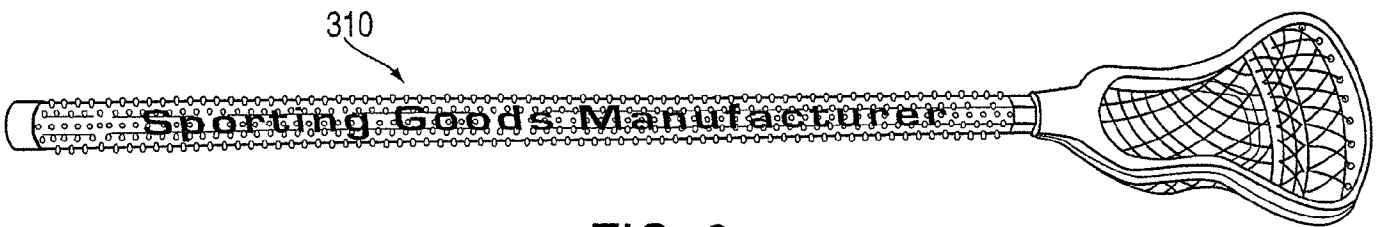
FIG. 9 is a perspective view of a lacrosse stick with a fourth embodiment of the invention completely installed.
Figure 10:
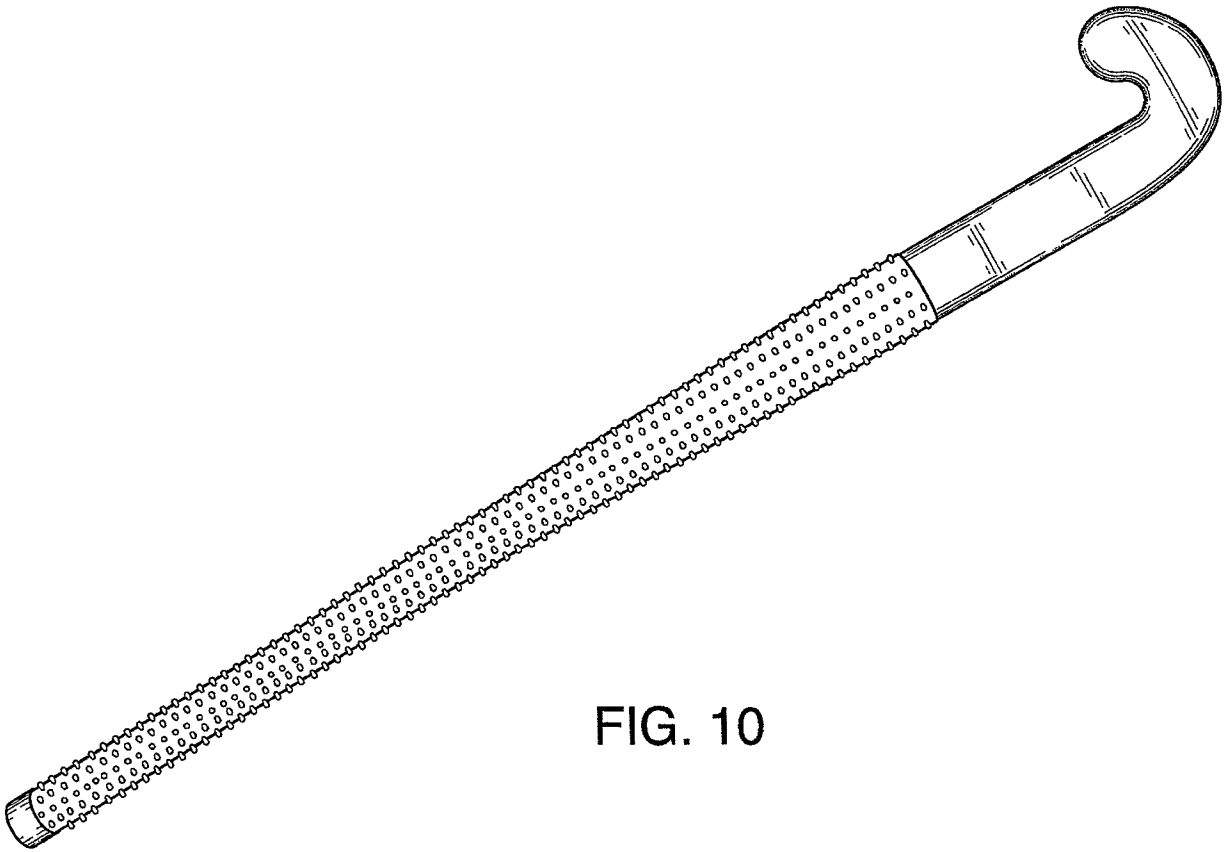
FIG. 10 is a perspective view of a field hockey stick with a fifth embodiment of the invention completely installed.

According to alternate embodiments of the invention, the sheath is color coordinated to team colors. The sheaths may also be imprinted with, e.g., team names, slogans, inspirational sayings or advertising. For example, FIG. 7 shows a second embodiment 110 which is imprinted with the name of a school and is colored to match the school colors. FIG. 8 shows a third embodiment 210 which is colored to match a different school's colors and is imprinted with a different school's name. FIG. 9 shows a fourth embodiment 310 which is imprinted with advertising.

Thus, as can be appreciated, various modifications may be made as will be apparent to those skilled in the art. For example, although the end caps are typically round or cylindrical, they could be configured to have a cross-section similar to that of the shaft which predominantly is octagonal although other shapes, such as round or oval, are also sometimes used. In addition, although the sheath of the cover typically has a thickness of about 1/16 to 1/4 inches, the same can be varied to suit the particular use or application and/or the official sport regulations governing such equipment. Furthermore, the cover may also possibly be modified for use in other sports for athletic equipment having a handle or shaft, such as tennis or field hockey. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. An assembly comprising:

athletic equipment having a shaft with a free end;

a removable cover for said shaft of said athletic equipment comprising a cap configured and dimensioned for mounting on said free end of said shaft, wherein said cap is cup-shaped and comprises a planar bottom wall with an outer peripheral edge and a generally tubular upstanding side wall having a first end and a second end, said first end being attached to said outer peripheral edge of said bottom wall; and a flexible, resilient membrane-like tubular sheath having a thickness of 1/16" to 1/4" which is configured and dimensioned to be rolled over itself to form a rolled configuration and having two opposite ends, one of which is coupled to said second end of said side wall of said cap and the other of which defines a free end, and wherein said tubular sheath is dimensioned and configured so that it can be unrolled longitudinally onto and along said shaft of said athletic equipment with said cap abutting and mounted on said free end of said shaft and said sheath being dimensioned and configured to afford a tight friction fit over said shaft when unrolled and which can be rolled longitudinally in the opposite direction along said shaft of said athletic equipment towards said free end of said athletic equipment and said cap, to permit removal of said cover from said athletic equipment and wherein said cap has a thickness which is greater than the thickness of said sheath and wherein said sheath is adhesive-less.

2. The assembly according to claim 1, wherein:

said sheath has a textured outer surface.

3. The assembly according to claim 2, wherein:

said textured outer surface is pebbled.

4. The assembly according to claim 1, wherein:

said sheath is made of a stretchable material which has a diameter which is less than the diameter of the shaft of said athletic equipment so that said sheath stretches to a tight friction fit over the shaft when unrolled.

5. The assembly according to claim 1, wherein:

said sheath is made from a flexible elastic polymer.

6. The assembly according to claim 1, wherein:

said cap is generally cylindrical.

7. The assembly according to claim 1, wherein: said sheath is imprinted.

8. The assembly according to claim 1, wherein: said sheath is cylindrical.

9. The assembly according to claim 1, wherein: said cap is integrally formed with said sheath.

* * * * *